United States Patent [19]

Darrah et al.

[11] 4,166,296

[45] Sep. 4, 1979

[54] AIR SUPPLY SYSTEM FOR THERAPEUTIC POOL

[75] Inventors: John L. Darrah; John C. Darrah, both of Arleta, Calif.

[73] Assignee: Gerald S. Stein, Woodland Hills, Calif.

[21] Appl. No.: 892,410

[22] Filed: Mar. 31, 1978

[51] Int. Cl.[2] ..... A47K 3/10; A47K 3/00

[52] U.S. Cl. ..... 4/178; 4/172; 4/180; 4/172.16; 128/66

[58] Field of Search ..... 4/178, 180, 173, 172, 4/172.15, 172.16; 128/66

[56] References Cited

U.S. PATENT DOCUMENTS

| | | | |
|---|---|---|---|
| 2,856,611 | 10/1958 | Valonis | 4/180 |
| 3,251,071 | 5/1966 | Wood | 4/180 X |
| 3,286,712 | 11/1966 | Roden | 4/178 X |
| 3,417,747 | 12/1968 | Beger | 124/66 |
| 3,736,922 | 6/1973 | Schneider | 128/66 |
| 3,805,772 | 4/1974 | Mickelson | 4/180 |

*Primary Examiner*—Henry K. Artis
*Attorney, Agent, or Firm*—Saul Epstein

[57] ABSTRACT

An air supply system for a therapeutic pool which allows placement of the air blower at a level below the water surface without danger of damage by water backflow. A check valve prevents gross water backflow to the blower, and a float valve between the check valve and the blower automatically drains any leakage of water through the check valve. The float valve is placed between the check valve and the blower in a manner so as to receive all leakage.

5 Claims, 3 Drawing Figures

AIR SUPPLY SYSTEM FOR THERAPEUTIC POOL

BACKGROUND OF THE INVENTION

1. Field of the Invention

This invention relates to the field of therapeutic pools and more particularly to air supply systems for such pools.

2. Description of the Prior Art

A therapeutic pool, or spa, is comprised of a water-filled tub large enough to accommodate the desired number of people neck deep and includes means for introducing air into the water through numerous orifices in the floor of the tub so that a large number of bubbles are formed and a pleasant sensation is created upon the body as they rise to the surface of the tub. Certain therapeutic benefits such as improved blood circulation are said to accrue from allowing bubbles to play on the surface of the skin and gently message it.

It is common to use a blower or pump to generate air pressure which is piped to a chamber under the tube and thence into the tube through a plurality of orifices in the tube bottom. Since water will flow back through the air supply piping when the blower is inoperative, the blower is normally positioned above the water line to prevent its being damaged by water backflow from the tube. It is desirable for esthetic reasons, however, to locate the blower below the water level, but in order to do so some means must be used to prevent water from backing up into the blower when the blower is off.

Prior to the present invention no satisfactory means for preventing such backflow had been devised. Common check valves have been tried, but thy invariably leak with resultant damage to the blower. Successful prior art spas therefore position the pumping means above the water surface, even though a more desirable position would be below the water level.

It is therefore an object of the present invention to provide a piping and valving system for a therapeutic pool which is economical and efficient and which will protect the system blower from water backflow even though the blower is positioned at a level below the water surface.

SUMMARY OF THE INVENTION

The therapeutic pool air system of the present invention includes a blower which can be positioned below water level and utilizes a check valve to prevent gross amounts of water from flowing to the blower when same is inoperative. The problem of leaks in the check valve is solved by the use of a novel float valve on the blower side of the check valve which will open to allow any water leaking past the check valve to escape, but which will automatically close after such leakage has escaped so that when the blower is turned on, no air will leak out, and air will flow from the blower to the spa.

Leakage past the check valve is continuously removed from the system through the float valve and can never build up so as to damage the blower.

DETAILED DESCRIPTION OF THE INVENTION

Figure 1:
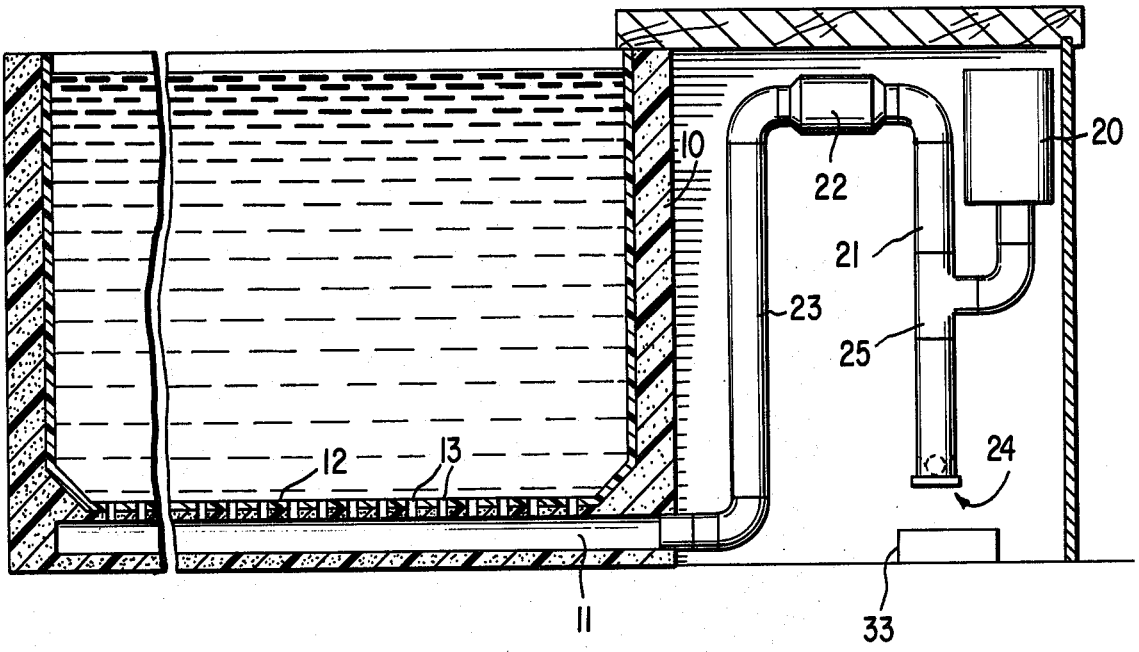
FIG. 1 is a piping diagram of a preferred arrangement of the invented air supply system.

Referring to FIG. 1, there is seen a water filled tub 10 having an air chamber 11 below its bottom 12. A plurality of orifices 13 through the bottom 12 provide a path from the air chamber into the tube. Air under pressure in the air chamber pass through the orifices 13 forming myriads of bubbles which rise to the surface, gently massaging the skin of persons in the tub.

Figure 2:
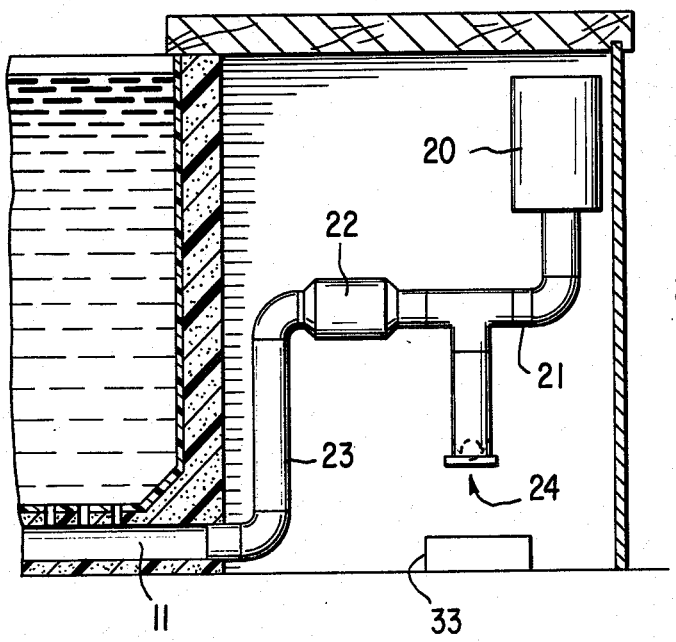
FIG. 2 is a piping diagram of a second arrangement of the invented air supply system.

The air which forms the bubbles is pressurized by blower 20 which may be placed above or below the surface of the water as desired. Air from blower 20 is coupled through piping 21 to a check valve 22 which prevents gross leakage of water from the tub back into the blower during the time the blower is off. Pipe 23 connects the check valve 22 to air chamber 11. Float valve 24 is connected to pipe 21 in such a manner that any reverse water leakage through valve 22 will flow into float valve 24 instead of to blower 20, for example, in the manner illustrated in FIG. 1 where float valve 24 is shown at the end of a vertical leg of pipe 21, and blower 20 is coupled into the side of a tee 25. FIG. 2 shows a second piping arrangement which accomplishes the same result as FIG. 1 but using a slight different piping arrangement.

It is preferred that check valve 22 be located at a relatively high level with respect to the surface of the water in the tub so that the back pressure on it, and therefore its tendency to leak when the blower is off will be minimized, but in accordance with the principles of the invention protection to the blower will be provided even when the check valve 22 is placed well below the tub water level as shown in FIG. 2. In both cases it will be seen that any leakage to water past check valve 22 will flow to float valve 24.

Figure 3:
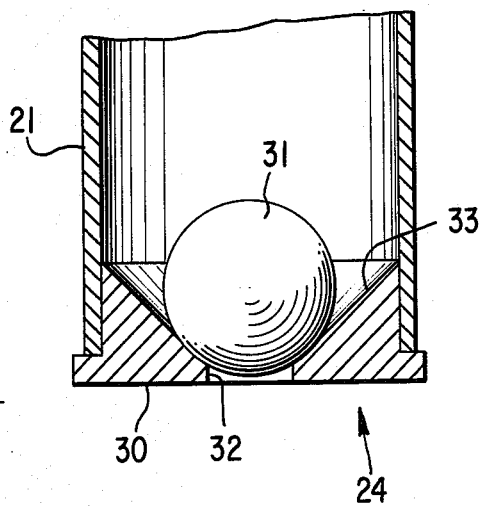
FIG. 3 is a cross-sectional view of the float valve used in the invented air supply system.

The preferred construction of the float valve 24 may be seen in detail in cross-section in FIG. 3. The valve comprises a valve seat 30 having an opening 32, and a conical seat 33. A ball 31, which is lighter than water, and which may be made of an elastomer, for example, a rubber hand ball acts as the valve closure. The ball 31 rests on seat 33 by gravity, and when the valve 24 is dry, the ball seals the opening. Air from blower 20 thus cannot leak out and will be conducted to the spa through the piping and orifices described. It is not necessary that the seat 33 be conical as shown. So long as the opening 32 is smaller than ball 31, the ball may rest on any shaped seat, for example, a square shoulder at the top of opening 32 would be satisfactory.

If, when the blower is off, some water finds its way back through check valve 22, the water will flow into float valve 24, and when a significant amount of water accumulates, ball 31 will float upward and the water will flow through opening 32 and out of the system. A pan 33 may be used to catch the leakage if desired. As soon as the excess water leaks out, valve 24 will close automatically and the system will be ready for operation.

What has been described is a novel piping system for a threapeutic pool which automatically drains the system so that no water can reach the blower and damage same, even if the blower is located below the level of the spa water surface. Various modifications of the embodiments described will occur to those skilled in the art and such modifications are considered to be within the spirit of the invention as defined by the appended claims.

What is claimed is:

1. An air supply system for a therapeutic pool which comprises:

an air blower;

conduit means for conducting air from said blower to said pool, said air entering said pool through a plurality of orifices below the surface of said pool;

a check valve in said conduit means for resisting the flow of water from said pool toward said blower; and a float valve coupled to said conduit means between said blower and said check valve whereby any leakage of water through said check valve will flow into said float valve, said float valve comprising:

a horizontal valve seat, and a closure for said valve seat having a density less than water whereby said valve will open when water flows thereto.

2. An airbsupply system as recited in claim 1 wherein said horizontal valve seat is a tapered seat and said closure is substantially spherical.

3. An air supply system as recited in claims 1 or 2 wherein said closure is a ball made of elastomer.

4. In an air supply system for a therapeutic pool which includes means for inhibiting water from said pool from reaching the source of air, means for draining water from the normally dry portion of the piping of said air supply system which comprises a float valve at a low point of said nominally dry piping comprising a horizontal valve seat and a ball closure therefor, said ball having a density less than water whereby said ball closure will float and allow any water accumulating on said valve seat to drain.

5. The improvement as recited in claim 4 and further including a check valve in said piping between said float valve and said pool whereby said check valve will prevent flow of substantial amounts of water from said pool to said float valve.

* * * * *